US010003162B2

(12) United States Patent
Nishimura

(10) Patent No.: US 10,003,162 B2
(45) Date of Patent: Jun. 19, 2018

(54) TERMINATION DEVICE

(71) Applicant: Hirose Electric Co., Ltd., Tokyo (JP)

(72) Inventor: Hiroaki Nishimura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days. days.

(21) Appl. No.: 15/696,044

(22) Filed: Sep. 5, 2017

(65) Prior Publication Data

US 2018/0069355 A1 Mar. 8, 2018

(30) Foreign Application Priority Data

Sep. 5, 2016 (JP) ..... 2016 173072

(51) Int. Cl.

| | |
|---|---|
| ***H01R 13/66*** | (2006.01) |
| ***H01R 24/44*** | (2011.01) |
| ***H01R 13/405*** | (2006.01) |
| *H01R 101/00* | (2006.01) |

(52) U.S. Cl.

CPC ..... *H01R 24/44* (2013.01); *H01R 13/405* (2013.01); *H01R 2101/00* (2013.01)

(58) Field of Classification Search

CPC ..... H01R 24/44; H01R 13/6616; H01P 1/266
USPC ..... 439/620.04, 578, 675; 333/22 R
See application file for complete search history.

(56) References Cited

U.S. PATENT DOCUMENTS 3,324,424 A * 6/1967 Barker ..... H01P 1/24 333/22 R
4,824,399 A * 4/1989 Bogar ..... H01R 24/542 29/747
4,838,813 A * 6/1989 Pauza ..... H01P 1/266 333/22 R
5,041,020 A * 8/1991 Michael ..... H01R 24/44 439/578
5,100,344 A * 3/1992 Truong ..... H01R 24/44 439/578
5,167,532 A * 12/1992 Bruno ..... H01R 24/44 333/244
6,015,315 A * 1/2000 Ensign ..... H01R 24/44 439/578
6,712,647 B2 * 3/2004 Khemakhem ..... H01P 1/266 439/133

(Continued)

FOREIGN PATENT DOCUMENTS

JP 4331529 B2 9/2009

*Primary Examiner* — Neil Abrams

(74) *Attorney, Agent, or Firm* — Procopio, Cory, Hargreaves & Savitch LLP

(57) ABSTRACT

The device is provided with an inner conductor electrically connected to a counterpart central terminal in a counterpart coaxial device, a tubular outer conductor having the inner conductor disposed in the center thereof, said outer conductor being electrically connected to a counterpart outer conductor in the counterpart coaxial device, a grounding conductor electrically connected to the outer conductor, a resistance element provided in the axial direction between the inner conductor and the grounding conductor, and an annular dielectric member provided between the inner conductor and the outer conductor such that the member has the inner conductor passing therethrough and, at the same time, the inner conductor and the outer conductor are spaced apart from each other in the radial direction.

8 Claims, 3 Drawing Sheets

(56) References Cited

U.S. PATENT DOCUMENTS

| | | | | |
|---|---|---|---|---|
| 6,942,522 | B2 * | 9/2005 | Nishimura | H01P 1/266<br>333/22 R |
| 7,262,672 | B2 * | 8/2007 | Lee | H01R 24/44<br>333/260 |
| 9,362,686 | B2 * | 6/2016 | Montena | H01R 13/6616 |
| 9,590,287 | B2 * | 3/2017 | Burris | H01P 1/266 |

* cited by examiner

TERMINATION DEVICE

CROSS REFERENCE TO RELATED APPLICATIONS

This Paris Convention Patent Application claims benefit under 35 U.S.C. § 119 and claims priority to Japanese Patent Application No. JP 2016-173072, filed on Sep. 5, 2016, titled "TERMINATION DEVICE", the content of which is incorporated herein in its entirety by reference for all purposes.

BACKGROUND

Technical Field

The present invention relates to termination devices and, in particular, to a coaxial termination device that can be used for high-frequency bands.

Background Art

Termination devices have been developed for the purpose of minimizing high-frequency signal reflection, preventing noise generation, and the like. For instance, an exemplary conventional termination device is shown in Japanese Patent No. 4331529. This termination device, which is connected to a counterpart coaxial connector in the axial direction, is provided with a first component having a terminal portion that is electrically connected to a counterpart center conductor of the counterpart coaxial connector and an outer conductor portion that is electrically connected to a counterpart outer conductor of the counterpart coaxial connector, and a second component having a grounding conductor portion that is electrically connected to the outer conductor portion of the first component, an intermediate portion that is resiliently connected to the terminal portion of the first component in the axial direction, and a resistance element that is electrically connected to the grounding conductor portion and the intermediate portion and that electrically connects the grounding conductor portion to the counterpart center conductor of the counterpart coaxial connector.

Desirably, the resistance of the termination device in the axial direction should be constant at all times. In the above described termination device example, the sum total of the resistance of the resistance element, the impedance appearing between the terminal portion and the outer conductor portion, and the impedance appearing between the resistance element and the outer conductor portion is desirably maintained at a constant value of, for example, about 50Ω in the axial direction.

However, in the past, there has not been an established technology for solving this problem and attempts to solve the problem have been made by trial-and-error depending on the device. In recent years, improved high-frequency characteristics have been increasingly sought after, while, at the same time, there is also increasing demand for device miniaturization. Accordingly, there exists a need to establish a technology that would solve the above-mentioned problem while satisfying these requirements.

PRIOR ART DOCUMENTS

Patent Documents

Patent Document 1: Japanese Patent No. 4331529.

SUMMARY

Problems to be Solved by the Invention

The present invention, which is designed to solve such prior-art problems, provides a proven technology for keeping the resistance of a termination device constant in the axial direction. In addition, it is an object of the invention to implement device miniaturization while achieving improvements in high-frequency characteristics. The present disclosure herein is directed to an invention that provides a proven technology for keeping the resistance of a termination device constant in the axial direction. Airspaces formed between the inner conductor and the outer conductor by mutually spacing apart the inner conductor and the outer conductor in the radial direction are disposed adjacent the dielectric member in the axial direction and the diameter of the inner peripheral surface of the outer conductor is expanded in the vicinity of the boundaries between the airspaces and the dielectric member, on the side located closer to the dielectric member than the airspaces in the axial direction.

Means for Solving the Problem

Based on new findings showing that impedance was readily variable in locations where the dielectric constant underwent abrupt changes, the inventors focused their attention on locations in a termination device where such changes were likely to occur, for example, the vicinity of the boundaries between a securing portion made of resin that secured the terminal portion to the outer conductor portion, and airspaces formed between the terminal portion and the outer conductor portion, and, upon performing numerous trial-and-error experiments using simulation equipment, discovered the optimum technology for minimizing the above-described changes as well as a proven technology adapted for device miniaturization.

In order to solve the abovementioned problem, the termination device according to one aspect of the invention is a termination device connected to a counterpart coaxial device, wherein said termination device is provided with: an axially extending inner conductor electrically connected to a counterpart central terminal in the counterpart coaxial device, a tubular outer conductor having the inner conductor disposed in the center thereof, said outer conductor extending in the axial direction and being electrically connected to a counterpart outer conductor in the counterpart coaxial device, a grounding conductor electrically connected to the outer conductor, a resistance element provided in the axial direction between the inner conductor and the grounding conductor, and an annular dielectric member provided between the inner conductor and the outer conductor such that the member has the inner conductor passing therethrough and, at the same time, the inner conductor and the outer conductor are spaced apart from each other in the radial direction, and airspaces formed between the inner conductor and the outer conductor by mutually spacing apart the inner conductor and the outer conductor in the radial direction are disposed adjacent the dielectric member in the axial direction, and the diameter of the inner peripheral surface of a cylindrical member of the outer conductor is expanded in the vicinity of the boundaries between the airspaces and the dielectric member in the axial direction.

In addition, in order to solve the abovementioned problem, the termination device according to another aspect of the invention is a termination device connected to a counterpart coaxial device, wherein said termination device is provided with: an axially extending inner conductor electrically connected to a counterpart central terminal in the counterpart coaxial device, a tubular outer conductor having the inner conductor disposed in the center thereof, said outer conductor extending in the axial direction and being electrically connected to a counterpart outer conductor in the counterpart coaxial device, a grounding conductor electrically connected to the outer conductor, a resistance element provided in the axial direction between the inner conductor and the grounding conductor, and an annular dielectric member provided between the inner conductor and the outer conductor such that the member has the inner conductor passing therethrough and, at the same time, the inner conductor and the outer conductor are spaced apart from each other in the radial direction, and airspaces formed between the inner conductor and the outer conductor by mutually spacing apart the inner conductor and the outer conductor in the radial direction are disposed adjacent the resistance element in the axial direction, and the diameter of the inner peripheral surface of a cylindrical member of the outer conductor is expanded in the vicinity of the boundaries between the airspaces and the resistance element in the axial direction.

It should be noted that the dielectric member may be used as a securing member for securing the inner conductor to the outer conductor. In addition, the resistance element may be a planar resistive substrate.

In the termination device of this aspect, in order to minimize changes in impedance due to abrupt changes in the dielectric constant in the vicinity of the boundaries between the dielectric member and the airspaces in the radial direction, the airspaces are provided such that the diameter of the inner peripheral surface of a cylindrical member of the outer conductor in the vicinity of these boundaries is expanded to thereby make it possible to maintain a constant resistance. In addition, since the outer conductor is formed of metal, it is easier to machine than resin and the like and is also adapted for device miniaturization.

In the termination device of the above-described aspect, it is preferable to adjust the diameter of the inner peripheral surface of a cylindrical member of the outer conductor according to the areas of the resistance element in which the impedances appearing with respect to the outer conductor differ in the axial direction.

Using the termination device of this aspect, it is easy to maintain a constant resistance by minimizing changes in impedance generated by the resistance element and the like.

In addition, in the termination device of above-mentioned aspect, it is preferable for a portion of the pads provided on the resistance element to be covered by at least a portion of the inner conductor in the axial direction, and for the width of the pads in a direction orthogonal to the axial direction to be adjusted separately in the region covered by a portion of the inner conductor in the axial direction and in the region not covered by a portion of the inner conductor in the axial direction.

In the termination device of this aspect, the width of the pads is adjusted to thereby make it possible to minimize changes in impedance and maintain a constant resistance.

Furthermore, in the termination device of the above-mentioned aspect, the width of the pads in a direction orthogonal to the axial direction in the region not covered by a portion of the inner conductor in the axial direction may be smaller than the width of the pads in a direction orthogonal to the axial direction in the region covered by a portion of the inner conductor in the axial direction.

Furthermore, in the termination device of above-mentioned aspect, the resistance element comprises the pads that include the region covered by a portion of the inner conductor in the axial direction and the region not covered by a portion of the inner conductor in the axial direction, and a resistor that is disposed to the side closer to the grounding conductor in the axial direction than said pads, and the width of the pads in a direction orthogonal to the axial direction in the region not covered by a portion of the inner conductor in the axial direction may be equal to the width of the resistor in a direction orthogonal to the axial direction.

DETAILED DESCRIPTION

A preferred embodiment of the present invention will be described below with reference to the accompanying drawings. It should be noted that while only the preferred embodiment is illustrated herein for convenience purposes, it is not intended to be restrictive of the present invention.

Figure 1:
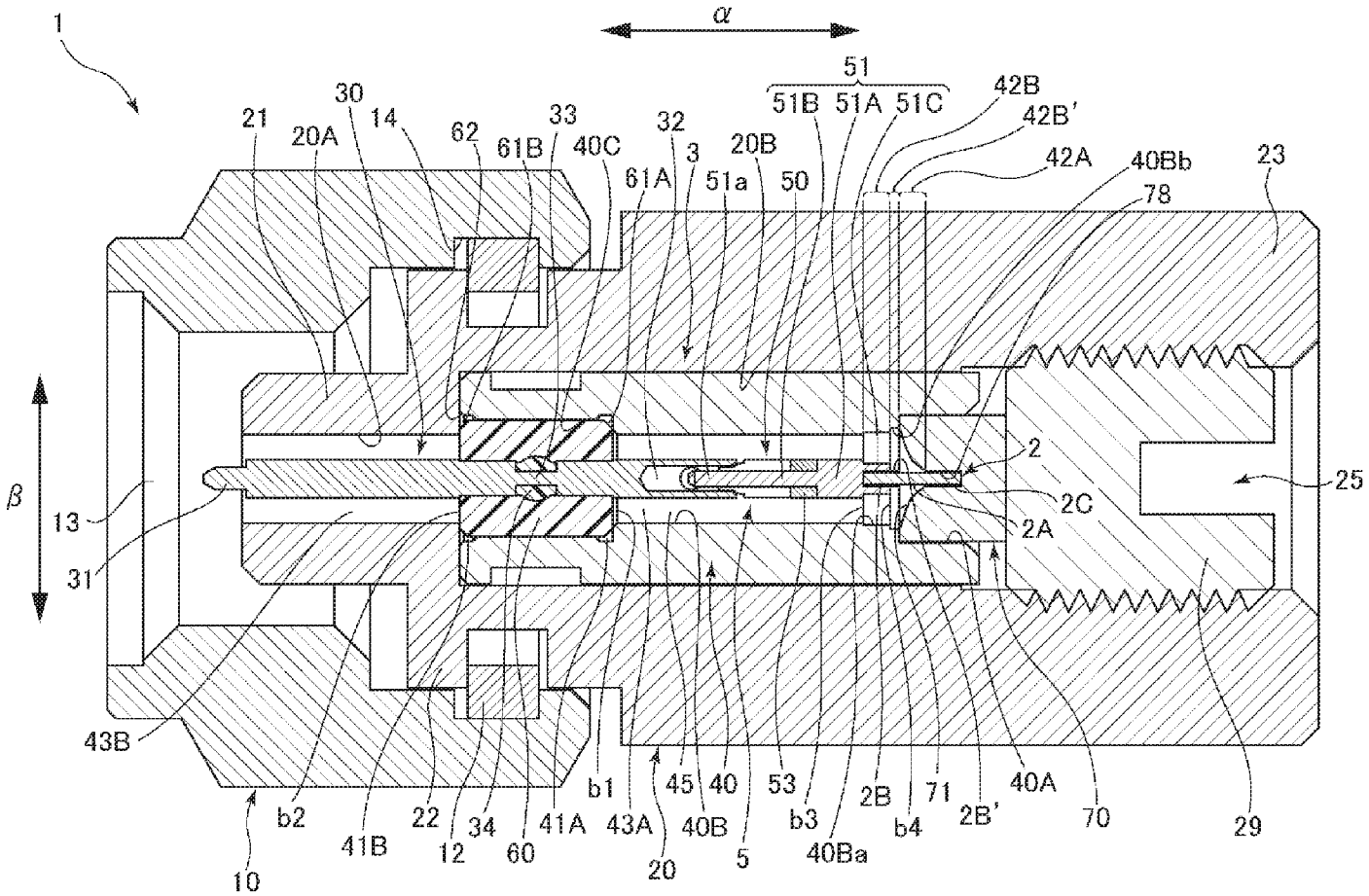
FIG. 1 illustrates a centerline cross-sectional view of a termination device used as an example of the present invention.

FIG. 1 shows a centerline cross-sectional view of a termination device used as an example of the present invention. The termination device 1 extends in the axial direction "α" and includes, for example, a metal connecting portion 10 with a regular hexagon-shaped cross-section having a relatively short length in the axial direction "α", a substantially cylindrical metal shell 20 having a relatively long length in the axial direction "α", and, furthermore, a first component 3 inserted and installed inside the shell 20, and a second component 5 inserted and installed inside the first component 3.

The first component 3 includes a substantially rod-shaped inner conductor 30 extending in the axial direction "α", a substantially cylindrical metal cylindrical member 40 extending in the axial direction "α", and an annular dielectric member 60 disposed inside the cylindrical member 40. Meanwhile, the second component 5 includes a substantially rod-shaped connection terminal 50 extending in the axial direction "α", a substantially cylindrical grounding conductor such as, for example, a connecting tube 70, and, furthermore, a resistance element such as a resistive substrate 2, for example, provided in the axial direction "α" between the connection terminal 50 and the connecting tube 70.

The shell 20 includes a reduced-diameter tubular member 21 provided on the front side, an expanded-diameter main body 23 provided on the rear side, and an annular flange 22 provided therebetween. A retainer 12 is fitted into an annular recessed portion 14 provided in the inner wall of the connecting portion 10 and extraction of the shell 20 from the connecting portion 10 is prevented by making this retainer 12 collide with the flange 22. A securing screw 29 is installed in the rear end portion of the main body 23, thereby preventing the first component 3 and second component 5 from falling out of the shell 20.

The shell 20 has a cylindrical holding space 25 formed therethrough in the axial direction "α". The holding space 25 is placed in communication with a through hole 13 provided in the connecting portion 10. The diameter of the anterior inner peripheral surface 20A of the holding space 25 formed by the tubular member 21 and flange 22 is set to a relatively small diameter. By contrast, the diameter of the posterior inner peripheral surface 20B of the holding space 25 is set to a relatively large diameter. Threading is formed in the end portion of the holding space 25 to allow the securing screw 29 to be secured.

The inner conductor 30 passes in the axial direction "α" through the center of a holding portion formed by the anterior inner peripheral surface 20A of the holding space 25. Meanwhile, the cylindrical member 40 passes in the axial direction "α" through a holding portion formed by the posterior inner peripheral surface 20B of the holding space 25 while being in contact with the inner peripheral surface 20B. The shell 20 and cylindrical member 40, as well as the connecting portion 10, which is in contact with the shell 20, can collectively form the outer conductor of the termination device 1.

The dielectric member 60 may be made, for example, of fluorocarbon resin (PTFE). In order to facilitate the insertion of the dielectric member 60 into the cylindrical member 40, tapers 61A, 61B are provided at the edges of the rear face b1 and front face b2 of the dielectric member 60. For the same reason, the insertion aperture of the cylindrical member 40 on the side where the dielectric member 60 is inserted is provided with tapers 62. It should be noted that while the side where the tapers 61B are provided is opposite to the side used to insert the dielectric member 60, the dielectric member 60 is a very small component, with a length in the axial direction of the termination device 1 is less than 2 mm, and therefore the direction of insertion of the dielectric member 60 is difficult to recognize with the naked eye. For this reason, tapers 61A, 61B are provided both on the rear face b1 and on the front face b2 of the dielectric member 60 to permit insertion using either side without identifying the presence or absence of tapers. However, the tapers 61A, 61B, and 62 are not essential.

The dielectric member 60 has the inner conductor 30 passing therethrough and, in addition, is disposed between the inner conductor 30 and the a cylindrical member 40 of the outer conductor 20 such that the inner conductor 30 and outer conductor 40 are spaced apart in the radial direction "β". The dielectric member 60 is used to provide the inner conductor 30 in the axial direction "α" in the center of the holding space 45 of the cylindrical member 40. In addition, the dielectric member 60 is used to electrically disconnect the inner conductor 30 from the cylindrical member 40. In order to secure the inner conductor 30 and the dielectric member 60, a portion of the lateral face of the inner conductor 30 is machined from the opposite side to leave a plate-like portion 33 in the center, and the space formed by such machining may be filled by an adhesive agent 34 such as epoxy resin or the like.

Figure 2:
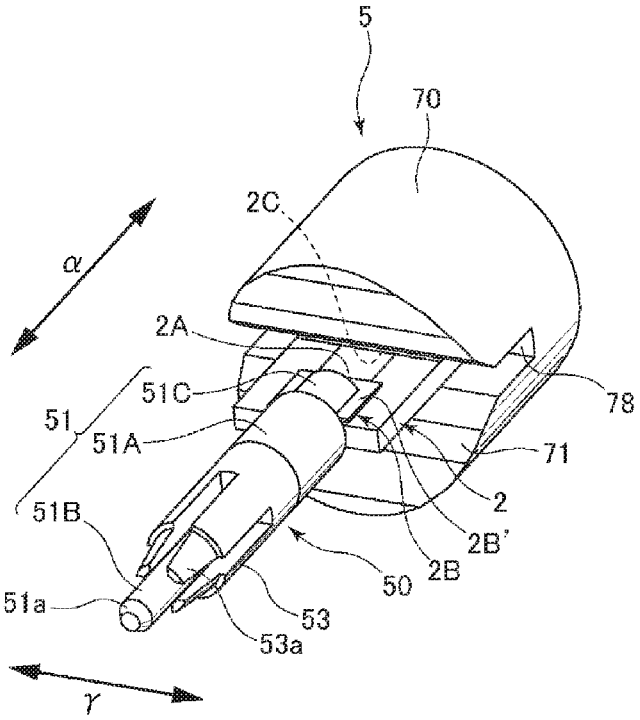
FIG. 2 illustrates an oblique view of the second component.
Figure 3:
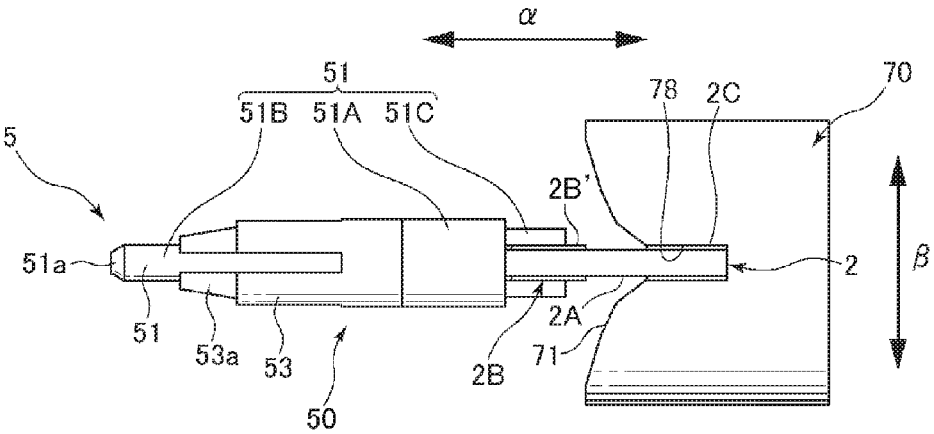
FIG. 3 illustrates a front elevation view of the second component.

The second component 5 will be described in greater detail with reference to FIG. 2 and FIG. 3 in addition to FIG. 1. FIG. 2 shows a perspective view of the second component 5 and FIG. 3 shows a front elevation view thereof. In the same manner as the inner conductor 30, the connection terminal 50 constituting the second component 5 extends in the axial direction "α" in the center of the holding space 45 of the cylindrical member 40.

The connection terminal 50 is made up of a base 51 and a notched member 53 attached to said base 51. The base 51 includes an expanded-diameter cylindrical main body 51A, a narrow-diameter rod-shaped portion 51B extending forward of this main body 51A, and two substantially D-shaped pinching portions 51C provided at the rear end of the main body 51A. The distal end 51*a* of the rod-shaped portion 51B is tapered. Multiple notched-out portions 53*a* are formed by providing multiple slits in the notched member 53 and the notched member 53 is installed in the base 51 such that the rod-shaped portion 51B passes through the center of these notched-out portions 53*a*. Under the action of the securing screw 29, the tapered distal end 51*a* of the rod-shaped portion 51B exposed beyond the distal end of the notched member 53, along with the notched-out portions 53*a* disposed along a rear perimeter of said distal end 51*a*, is threadedly driven in the axial direction "α" and inserted into a hole 32 (see FIG. 1) provided in the rear end portion of the inner conductor 30. As a result, the inner conductor 30 and connection terminal 50 are physically and electrically connected and all of these components can collectively form the inner conducting member of the termination device 1. Meanwhile, the rear end of the connection terminal 50 is secured to the resistive substrate 2 in the axial direction "α" by the pinching portions 51C. The connection terminal 50 is secured to the resistive substrate 2 by vertically pinching the front side of the resistive substrate 2 with the pinching portions 51C, in other words, such that at least a portion of the front end of the resistive substrate 2 is covered thereby. The rear end of the resistive substrate 2 is inserted and installed in an indentation 78 provided in the connecting tube 70 and is connected to ground.

The connecting tube 70 is disposed such that its lateral surface is in contact with the inner peripheral surface 40A in the rear side of the cylindrical member 40. As a result, the connecting tube 70 is electrically connected to the cylindrical member 40 and is further connected to the connecting portion 10 and shell 20 through the cylindrical member 40. Tapers 71 are formed in the connecting tube 70 in an anterior-to-posterior direction towards the central indentation 78. Although the impedance between the connecting tube 70 and resistive substrate 2 appears mainly in the radial direction "β", a constant resistance can be maintained by adjusting the impedance with the help of the tapers 71.

A counterpart coaxial apparatus, for example, a counterpart coaxial connector (not shown in the drawing), is connected to the connecting portion 10 side in the axial direction "α". At such time, a counterpart outer conductor provided in the counterpart coaxial connector is physically connected to the tubular member 21 and connecting portion 10 of the termination device 1, and, as a result, is electrically connected to the connecting portion 10, shell 20, and cylindrical member 40 constituting the outer conductor. Furthermore, at such time, a counterpart central terminal provided in the counterpart coaxial connector is physically connected to the inner conductor 30 of the termination device 1, in particular, in the vicinity of its distal end 31, and, as a result, is electrically connected to the inner conductor 30 and connection terminal 50 constituting the inner conducting member.

The outer conductor, in particular, the shell 20 and cylindrical member 40, are mutually spaced apart from the inner conductor 30 and connection terminal 50 in the radial direction "β". As a result, an airspace 43A is formed between the inner peripheral surface 40B near the center of the cylindrical member 40 and the inner conductor 30, the connection terminal 50 and the resistive substrate 2, and an airspace 43B is formed between the inner conductor 30 and the inner peripheral surface 20A of the tubular member 21 of the shell 20. These airspaces 43A, 43B are both disposed adjacent the dielectric member 60 in the axial direction "α". The dielectric constant of the dielectric member 60 is substantially different from that of the airspaces 43A, 43B (for example, about double that in the case of the relative dielectric constant of PTFE, from which the dielectric member 60 is formed), as a result of which the dielectric constant abruptly changes in the vicinity of the boundaries between the dielectric member 60 and the airspaces 43A, 43B. As a result of focusing their attention on the fact that impedance was readily variable in locations where the dielectric constant underwent abrupt changes and accumulating experimental results by conducting simulations of the vicinity of the boundaries between the dielectric member 60 and the airspaces 43A, 43B, the inventors determined that changes in impedance could be minimized by expanding the diameter of the inner peripheral surface 40C of the cylindrical member 40 in the vicinity of the boundaries between the dielectric member 60 and the airspaces 43A, 43B in the axial direction "α", which, in the present example, is in the vicinity of the boundary b1 of the rear face and the airspace 43A and the boundary b2 of the front face of the dielectric member 60 and the airspace 43B. Although the details of the mechanism are unclear, it is presumed that, as a result of expanding the diameter of the inner peripheral surface 40C of the cylindrical member 40, airspaces 41A, 41B are formed by the expanded-diameter portions, and these airspaces 41A, 41B are used to increase the impedance appearing between the inner conductor 30 and connection terminal 50 and the cylindrical member 40 right before the airspaces 43A, 43B, thereby allowing for a constant resistance to be maintained. It should be noted that since the cylindrical member 40 is formed of metal, it is easier to machine than resin and the like and more readily lends itself to sizing. For this reason, this configuration makes it possible to easily perform diameter adjustments despite the small size of the termination device.

Figure 4:
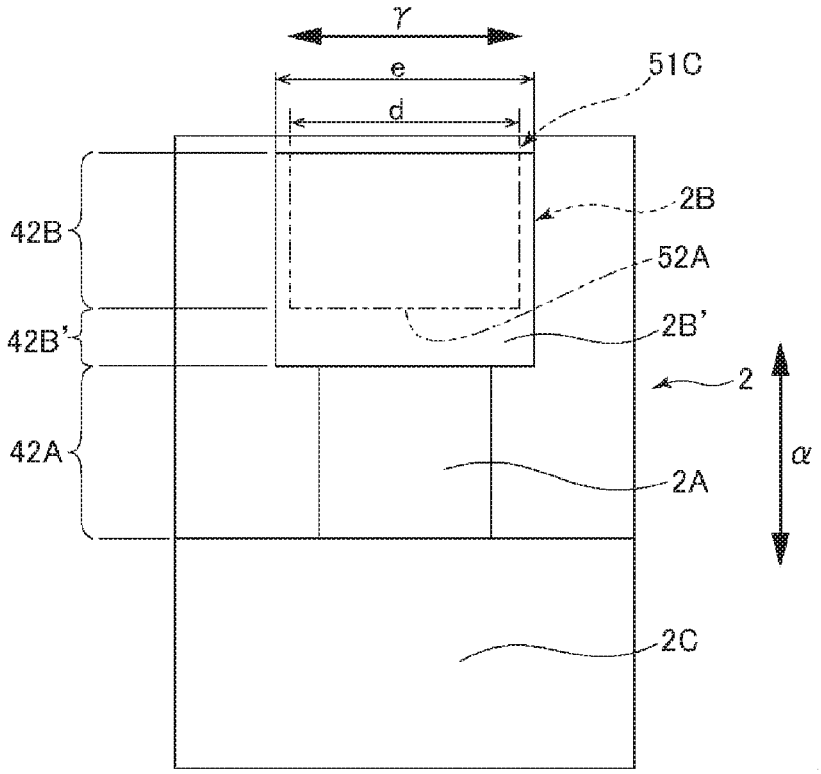
FIG. 4 illustrates a schematic plan view of the resistive substrate.

Next, the configuration of the resistive substrate 2 will be described in detail by referring to FIG. 4, in addition to FIGS. 1 to 3. FIG. 4 is a schematic plan view of the resistive substrate 2.

One of the end regions, 2C, of the resistive substrate 2 is inserted and installed in the indentation 78 of the connecting tube 70 and is connected to ground. Pads 2B are provided in the other end region of the resistive substrate 2, and, furthermore, a resistor 2A is provided to the side closer to the connecting tube 70 in the axial direction "α" than the pads 2B. The resistor 2A, which is used to adjust the impedance such that the resistance at one end 2C of the resistive substrate 2 is set to zero, is provided in the axial direction "α" in a resistive region 42A located directly underneath the tapers 71 of the connecting tube 70.

A portion of the pads 2B is vertically pinched between the pinching portions 51C of the connection terminal, in other words, covered by the pinching portions 51C of the connection terminal. Even after being covered by the pinching portions 51C, a small portion, 2B', of the pads 2B protrudes from the pinching portions 51C in the axial direction "α" as well as in a direction "γ" orthogonal to the axial direction "α". The connecting member 50 can be secured to the resistive substrate 2 by applying solder to the external surface of the pinching portions 51C and this overhanging portion 2B'.

In the axial direction "α", the pads 2B include a region, 42B, that is covered by the pinching portions 51C (hereinafter referred to as the "covered region"), and a region, 42B', that is not covered by the pinching portions 51C (hereinafter referred to as the "uncovered region"). The resistance values of the covered region 42B and the uncovered region 42B' are different, as a result of which the impedance appearing between the resistive substrate 2 and the outer conductor, in particular, the shell 20 and the cylindrical member 40, is different in the covered region 42B and the uncovered region 42B'. In this configuration, in order to keep the resistance of the termination device 1 constant in the axial direction "α", impedance adjustment is implemented in accordance with this difference by adjusting the diameter of the inner peripheral surface 40B of the outer conductor 40 in the axial direction "α". As a result of accumulating experimental results by conducting simulations of the vicinity of the boundary b3 between the covered region 42B and the airspace 43A as well as the vicinity of the boundary b4 between the covered region 42B and the uncovered region 42B' where the dielectric constant was likely to undergo abrupt changes, in the same manner as with the boundaries b1 and b2, the inventors determined that changes in impedance could be minimized by respectively expanding the diameter of the inner peripheral surface 40Ba and the inner peripheral surface 40Bb of the cylindrical member 40 in the vicinity of the boundary b3 in the axial direction "α", on the side located closer to the covered region 42B, and, in addition, in the vicinity of the boundary b4 in the axial direction "α", on the side located closer to the uncovered region 42B'. Although the details of the mechanism are unclear, it is presumed that, in the same manner as with the above-described boundaries b1 and b2, expanding the diameter of the inner peripheral surface 40Ba in the covered region 42B and the diameter of the inner peripheral surface 40Bb in the uncovered region 42B' makes the airspaces larger, in other words, reduces the dielectric constant and, as a result, increases the impedance appearing between the covered region 42B, uncovered region 42B' and the cylindrical member 40, thereby allowing for a constant resistance to be maintained. For instance, in this example, the diameter of the inner peripheral surface 40Ba of the cylindrical member 40 of the outer conductor in the covered region 42B is set to be slightly larger than the regular diameter of the inner peripheral surface 40B and, in addition, the diameter of the inner peripheral surface 40Bb of the cylindrical member 40 of the outer conductor in the uncovered region 42B' is set to be slightly larger than the diameter of the inner peripheral surface 40Ba of the cylindrical member 40 of the outer conductor in the covered region 42B.

Figure 5:
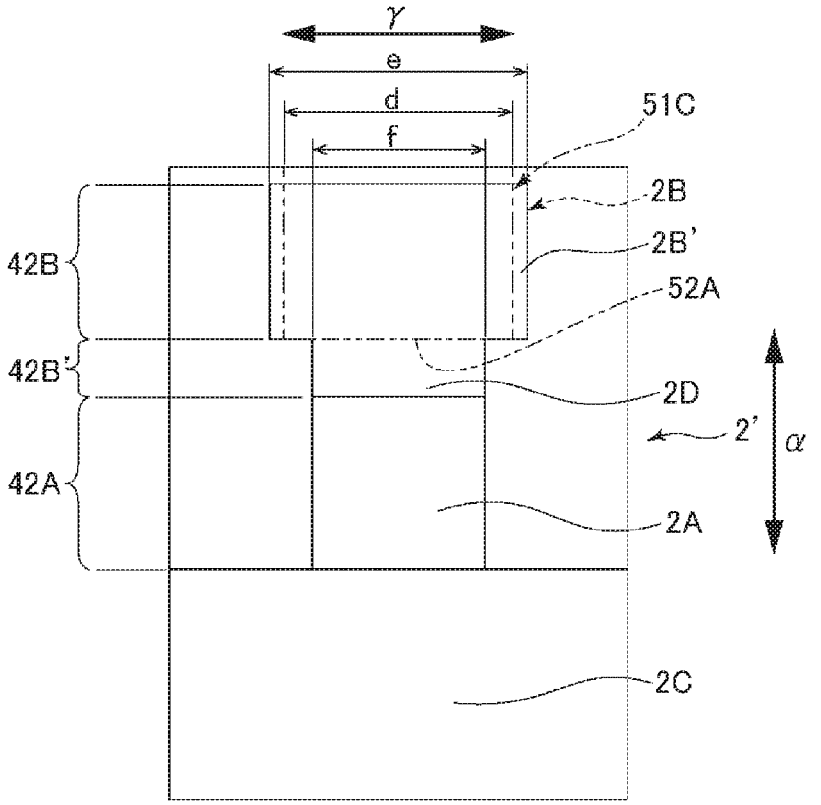
FIG. 5 illustrates a drawing illustrating an exemplary variation of the resistive substrate.

Instead of changing the diameter of the inner peripheral surface of the cylindrical member 40 of the outer conductor, or in addition thereto, impedance adjustments may be implemented by adjusting the width of the pads 2B in the orthogonal direction "γ" differently depending on whether this is the covered region 42B or the uncovered region 42B'. In the example illustrated in FIG. 4, the width "e" of the pads 2B in the orthogonal direction "γ" in the uncovered region 42B' is set to be slightly larger than the width "d" of the pads 2B in the same direction "γ" in the covered region 42B. By contrast, in the resistive substrate 2' illustrated in FIG. 5, impedance is adjusted by making the width "f" of the pads 2D in the orthogonal direction "γ" in the uncovered region 42B' smaller than the width "e" of the pads 2B in the orthogonal direction "γ" in the covered region 42B. In such a case, the width "f" of the pads 2B in the orthogonal direction "γ" in the uncovered region 42B' can be reduced to a width equal to the width "f" of the resistor 2A in the same direction "γ". What width is required can be easily determined by calculation.

It should be noted that the present invention is not limited to the above-described embodiment and various other modifications are possible. Accordingly, the drawings and descriptions are merely illustrative and not restrictive.

DESCRIPTION OF THE REFERENCE NUMERALS

1 Termination device
2 Resistive substrate (resistance element)
2A Resistor
2B Pad
2C End region
3 First component
5 Second component
10 Connecting portion (outer conductor)
20 Shell (outer conductor)
21 Tubular portion/member
30 Connection terminal (inner conductor)
34 Securing portion
40 Cylindrical body (outer conductor)
42A Resistive region
42B Covered region
42B' Uncovered region
43A Airspace
43B Airspace
50 Connection terminal (inner conductor)
51C Pinching portion
60 Dielectric member (insulating washer)
70 Connecting tube

What is claimed is:

1. A termination device connected to a counterpart coaxial device, wherein said termination device comprises:

an axially extending inner conductor electrically connected to a counterpart central terminal in the counterpart coaxial device, a tubular outer conductor having the inner conductor disposed in the center thereof, said outer conductor extending in the axial direction and being electrically connected to a counterpart outer conductor in the counterpart coaxial device, a grounding conductor electrically connected to the outer conductor, a resistance element provided in the axial direction between the inner conductor and the grounding conductor, an annular dielectric member provided between the inner conductor and the outer conductor such that the member has the inner conductor passing therethrough and wherein the inner conductor and the outer conductor are spaced apart from each other in the radial direction, and airspaces formed between the inner conductor and the outer conductor by mutually spacing apart the inner conductor and the outer conductor in the radial direction are disposed adjacent the dielectric member in the axial direction and a diameter of the inner peripheral surface of the outer conductor is expanded in the vicinity of boundaries between the airspaces and the dielectric member in the axial direction.

2. A termination device connected to a counterpart coaxial device, wherein said termination device comprises:

an axially extending inner conductor electrically connected to a counterpart central terminal in the counterpart coaxial device, a tubular outer conductor having the inner conductor disposed in the center thereof, said outer conductor extending in the axial direction and being electrically connected to a counterpart outer conductor in the counterpart coaxial device, a grounding conductor electrically connected to the outer conductor, a resistance element provided in the axial direction between the inner conductor and the grounding conductor, an annular dielectric member provided between the inner conductor and the outer conductor such that the member has the inner conductor passing therethrough and wherein the inner conductor and the outer conductor are spaced apart from each other in the radial direction, and airspaces formed between the inner conductor and the outer conductor by mutually spacing apart the inner conductor and the outer conductor in the radial direction adjacent to the resistance element in the axial direction, and wherein a diameter of the inner peripheral surface of the outer conductor is expanded in the vicinity of boundaries between the airspaces and the resistance element in the axial direction, on the side located closer to the resistance element.

3. The termination device according to claim 2, wherein the diameter of the inner peripheral surface of the outer conductor is adjusted separately for the regions of the resistance element in which the impedances appearing with respect to the outer conductor differ in the axial direction.

4. The termination device according to claim 2, wherein a portion of the pads provided on the resistance element is covered by at least a portion of the inner conductor in the axial direction, and the width of the pads in a direction orthogonal to the axial direction is adjusted separately in the region covered by a portion of the inner conductor in the axial direction and in the region not covered by a portion of the inner conductor in the axial direction.

5. The termination device according to claim 4, wherein the width of the pads in a direction orthogonal to the axial direction in the region not covered by a portion of the inner conductor in the axial direction is smaller than the width of the pads in a direction orthogonal to the axial direction in the region covered by a portion of the inner conductor in the axial direction.

6. The termination device according to claim 5, wherein the resistance element comprises the pads that include the region covered by a portion of the inner conductor in the axial direction and the region not covered by a portion of the inner conductor in the axial direction, and a resistor that is disposed to the side closer to the grounding conductor in the axial direction than said pads, and the width of the pads in a direction orthogonal to the axial direction in the region not covered by a portion of the inner conductor in the axial direction is equal to the width of the resistor in a direction orthogonal to the axial direction.

7. The termination device according to claim 2, wherein the dielectric member is used as a securing member securing the inner conductor to the outer conductor.

8. The termination device according to claim 2, wherein the resistance element is a planar resistive substrate.

* * * * *